US006116601A

United States Patent [19]

Kornafel, Jr.

[11] Patent Number: 6,116,601

[45] Date of Patent: Sep. 12, 2000

[54] BOARD GAME APPARATUS

[76] Inventor: Stanley E. Kornafel, Jr., 668 Mohawk Ave., Norwood, Pa. 19074

[21] Appl. No.: 09/167,089

[22] Filed: Oct. 5, 1998

[51] Int. Cl.[7] ..... A63F 3/00; A63F 7/30

[52] U.S. Cl. ..... 273/249; 273/251; 273/138.1; 273/287

[58] Field of Search ..... 273/249, 244, 273/243, 440, 250–254, 144 A, 144 B, 144 R, 138.1, 287

[56] References Cited

U.S. PATENT DOCUMENTS

| | | | |
|---|---|---|---|
| 3,594,002 | 7/1971 | Glass | 273/249 |
| 4,346,899 | 8/1982 | Nuebling, Sr. | 273/244 |
| 4,655,461 | 4/1987 | Capri et al. | 273/249 |
| 4,999,001 | 3/1991 | Johnson, Jr. | 273/269 |
| 5,340,113 | 8/1994 | Respicio | 273/249 |
| 5,462,282 | 10/1995 | Romano | 273/240 |

*Primary Examiner*—Benjamin H. Layno

[57] ABSTRACT

A board game apparatus is disclosed for playing a competitive, fun, and educational game enabling the development of judgmental and reasoning skills and offers or involves chance, personal notions, perception, skill, and strategy with a board designed containing a path of blank and/or marked spaces and/or blocks maintaining a progression and continuity about the board and from a "Start/Finish" block the concept is that players through usage of a dice, a spinner format uniquely utilized in offering modification of the game pieces' movement and/or other items or features, moving their pieces within the rules, a winner may be determined by reaching the "Finish/Start" block. The original concepts include: a board designed in sections to enable enlargement; an action utensil card requiring choices and strategy; a utility card enabling game prolongation; "Hole-A-Bowl", an original designed form of chance and skill; "Weather Quackers", a featured manner of using disks for chance; plus sets of directive action cards; providing possible interference with the moving player or interfacing or interaction with other players. Chance or guessing is afforded through the singular or combined use of: devices, features, cards, or board blocks/spaces and the use of the sphere and spinner-indicator affords some manual skill. The uniqueness of the invention, however, is it's draw on perception and strategy through the combining or use of the board, equipment, features and/or action cards that may cause the interfacing or interactions with the other players. This concept of features and their manner of utilization provides a challenging game of higher concentration and strategy; while producing fun and some educational relevancy to daily life obstacles, stresses, or joys.

5 Claims, 8 Drawing Sheets

63

64

16

BOARD GAME APPARATUS

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO MICROFICHE APPENDIX

Not Applicable

BACKGROUND OF THE INVENTION AND PRIOR ART

This invention relates in general to board games and game boards, but in particular to those existing with designated areas to be secured or reached involving a path or paths. Methods of choice and chance in prior art have previously provided players the norm of success via elimination of opponents, speed to a place, or the accumulation of value and/or items. These prior art forms, while still praiseworthy, offer limited numbers and varieties of chance, interaction, and are of little or no educational value.

Unknown is any prior art which contains the numerous or diverse means of chance, required guessing, drawing on personal or reciprocal notions, interfacing actions, along with an alternative method of play and a board so designed as to permit enlargement or alteration through added board inserts as the herein shown disclosed invention apparatus.

Classes of search performed: D/21, 40/372–575, 52/DIG10, 116/222–322, 200/161, 238, 273, 312, 340, 364, 434, 446, 463, and 473.

Examples of prior art with relevance are listed below:

| U.S. Pat. No. # | Inventor | Month and Year |
|---|---|---|
| 688,027 | Toaspern | February 1901 |
| 1,165,688 | Maris | December 1915 |
| 2,026,082 | Darrow | December 1935 |
| 2,603,489 | Baumberger | July 1952 |
| 2,976,044 | Corpending | March 1961 |
| 3,211,459 | Knopinski | October 1965 |
| 4,040,628 | Pope | August 1977 |
| 4,522,407 | Hatherly | June 1985 |

BRIEF SUMMARY OF THE INVENTION

This game apparatus uses a single board comprised of two (2) sections, with the concept of enabling enlargement or variations through use of future extra attachment boards. The object of the game being for a player to reach "Finish" within the rules having begun at "Start" and following a path of blocks or spaces in continuity. Some portions of some parts of prior art may relate to this game invention, as having a board, a path, bonuses, and/or penalties, but only in generalities.

As in other prior art, a die is used to initiate the players move. However, in this invention a die known as the "Dieput" is further developed to be used as well as or with other apparatuses or equipment or in conjunction with action cards to enable a higher number of chance or diverse occasions. A spinner known as the "Thrill-N-Twirl" may also be found in prior art but with use mostly limited to chance is herein further developed to require some manual skill plus thought and as an episode enhancer.

The original idea of the "Hole-A-Bowl" to combine use of manual skill, and chance, is a solely devised feature, not found in prior art.

The "Weather Quackers" a set of disks mannered to associate to the weather is another established solely devised method of chance not found in prior art.

The concept of the "Decision Passport", an action utensil card, a solely devised feature not found in prior art, requires a choice, involves chance, and may enable guessing, perception, and use of strategy.

The idea of the "Vacation Extension" an overlay utility card is to enable the alteration of the duration of the game.

The concept of the directive action card "Fun Time!" is to create positive atmosphere and mostly jubilation by causing or providing interfacing or direct interactions with other players.

The original idea of the directive action cards "Now What?" and "Why Me?" is to create negative atmosphere and mostly apprehension by causing or providing interference with the player in movement.

Within the preferred embodiment is a feature of an alternative mode of play "Variety Version" which modifies the rules only, since the board itself remains as the devised unique and original, strategically competitive and educational game of chance, intrusiveness, challenge, skill and strategy.

BRIEF DESCRIPTION OF THE SEVERAL VIEWS OF THE DRAWINGS

Dwg. 1 is a plan view of the main features of the game apparatus showing the: gameboard 1 of its two (2) sections 2 & 3, main path and offshoots 26, travel direction pointers, instructions 35, luggage 36, dieput 17, tumbler 30, thrill-n-twirl 15, decision passport 32, vacation extension 33, Extend words 24 & 25, directive cards 12, 13 & 14, Resort spaces 5 & 8, weather quackers 31 and hole-a-bowl 18. The complete wording of all cards and rules are in the detailed description.

DETAILED DESCRIPTION OF THE INVENTION

Figures 1, 2:
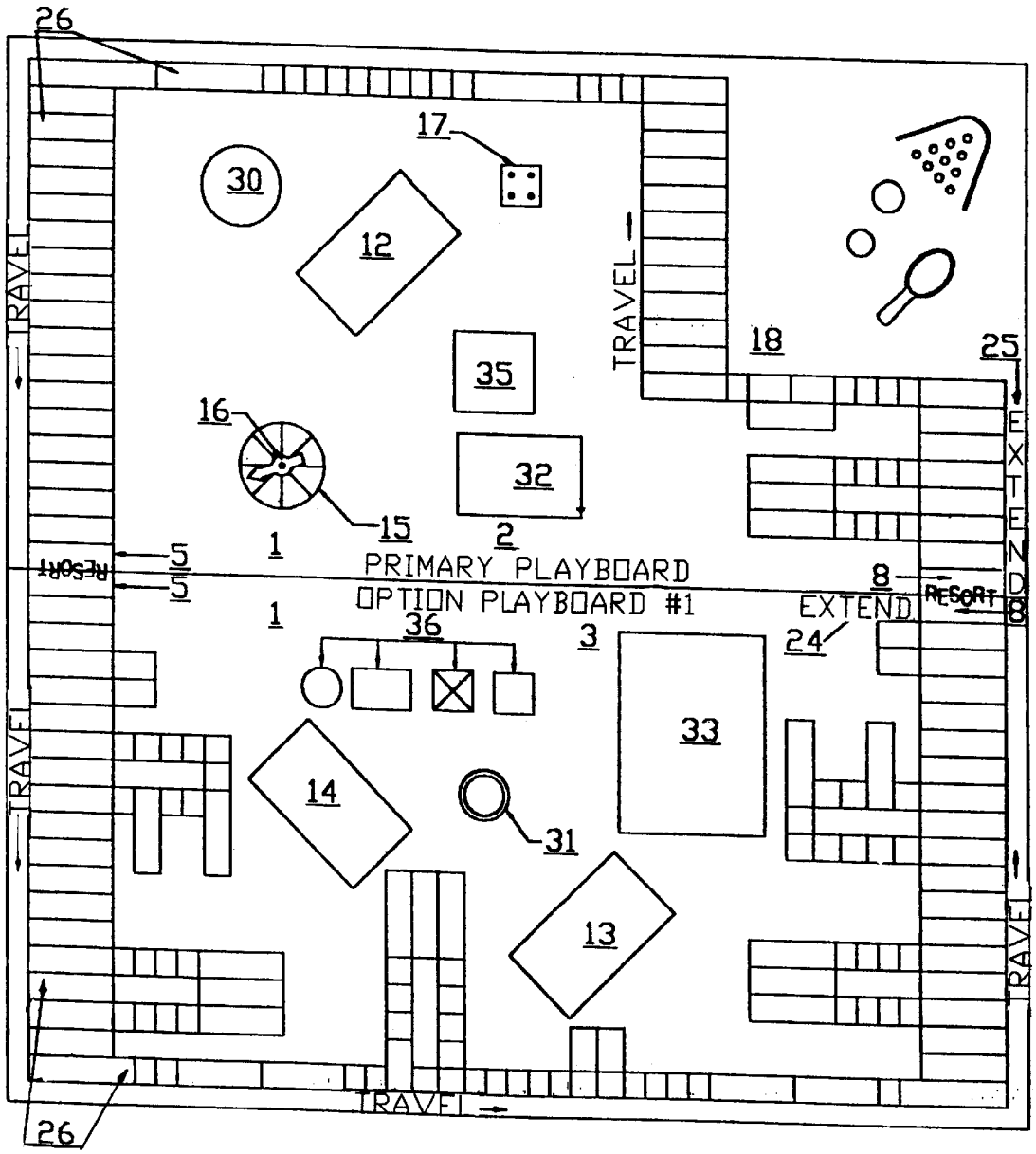
FIG. 1 Dwg. 2 is an enlarged plan view of the Optional Playboard #13 section of the gameboard 1 illustrating the: main path and offshoots 26, horizontal extend word 24 and two (2) alignment resort blocks 5 & 8. The complete wording and sequence of the main path and offshoots 26 is specified in the detailed description. Following is shown: Extension utility card 33, location of the Action cards now what? 14 and why me? 13, block sizes example 21, offshoots example 38. For reference are selected spaces: 6, 7, 27, 28, 37, 39, 40, 41, 42, 43, 44, 45, 46, 47, 53, 54, 55, & 56.
FIG. 2 Dwg. 3 is an enlarged plan view of the Primary Playboard 2 section of the gameboard 1 illustrating the: main path and offshoots 26, vertical extend word 25 and two (2) alignment resort blocks 5 & 8. The complete wording and sequence of the main path and offshoots 26 is specified in the detailed description. Following shown is the: hole-a-bowl 18 format with poosher rest spot 23, poosher 63, sphere 62, triangle set or receivers 22, backwall 64 and slots 34 for backwall tabs also shown is the: thrill-n-twirl 15, with format 19, pointer/indicator 16, and start arrow 20, instructions/rules booklet 35, decision passport 32, blocks wording example 29, and location of the action cards fun time! 12. Noted for reference are related spaces: 4, 9, 10, 11, 48, 49, 50, 51, 52, 57, 58, 59, 60 & 61.
Figure 1:
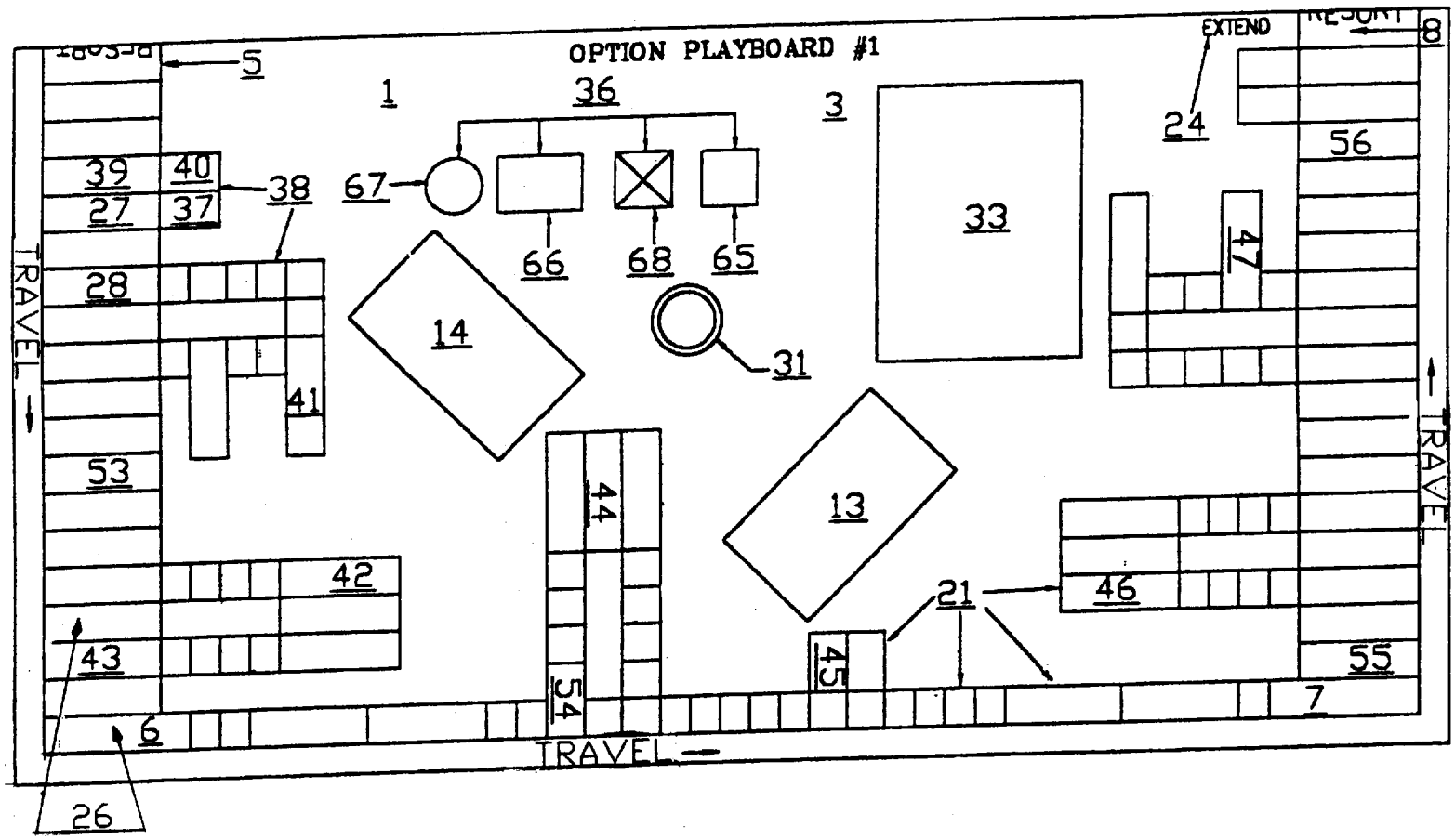
Figure 2:
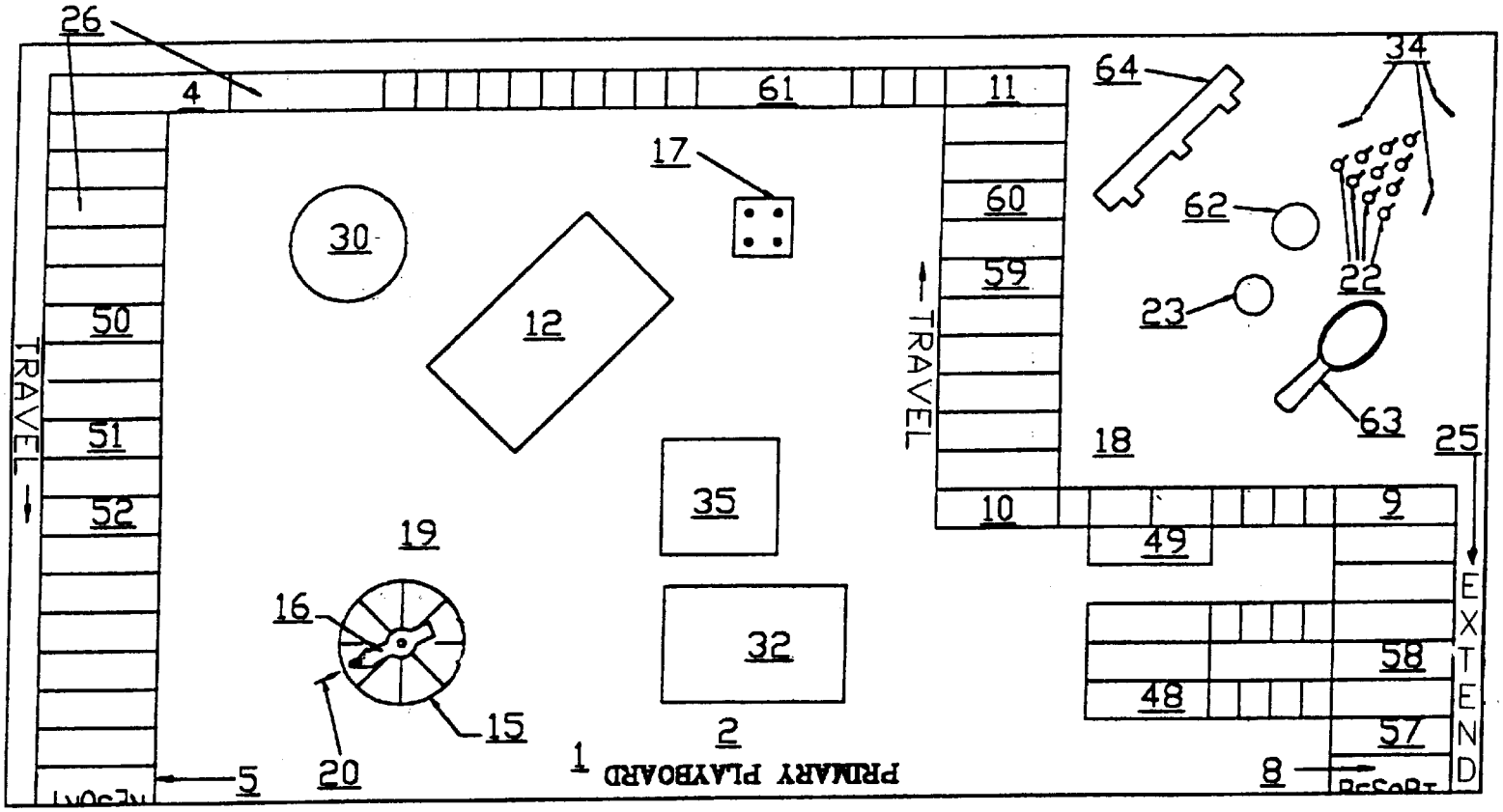
Figure 3:
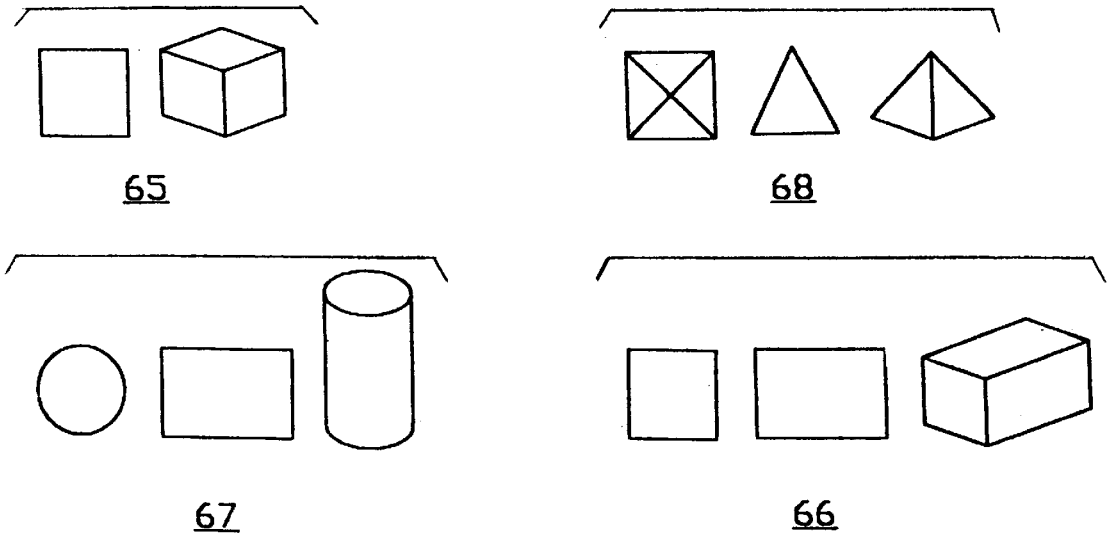
FIG. 3 Dwg. 4 illustrates the variety of luggage 36 of the cube 65 in plan view and isometric views plus the rectangle 66, cylinder 67 and pyramid 68 in plan elevated and isometric views.
Figure 4:
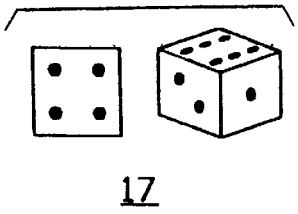
FIG. 4 Dwg. 4 illustrates the dieput 17 in plan and isometric views.
Figure 5:
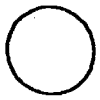
FIG. 5 Dwg. 4 illustrates the sphere 62 in a plan view.
Figure 6:
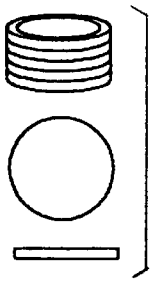
FIG. 6 Dwg. 5 illustrates the weather quackers 31 in plan, elevated and isometric views.
Figure 7:
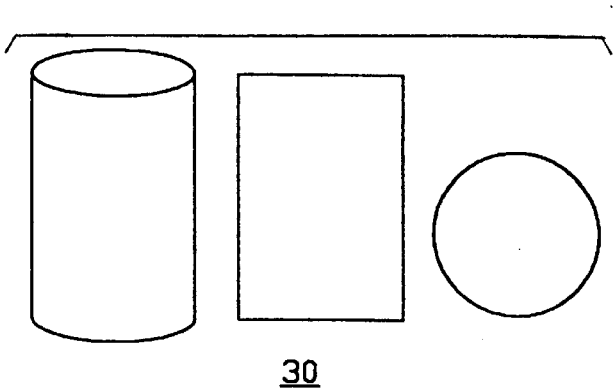
FIG. 7 Dwg. 5 illustrates the tumbler 30 in plan, elevated and isometric views.
Figure 8:
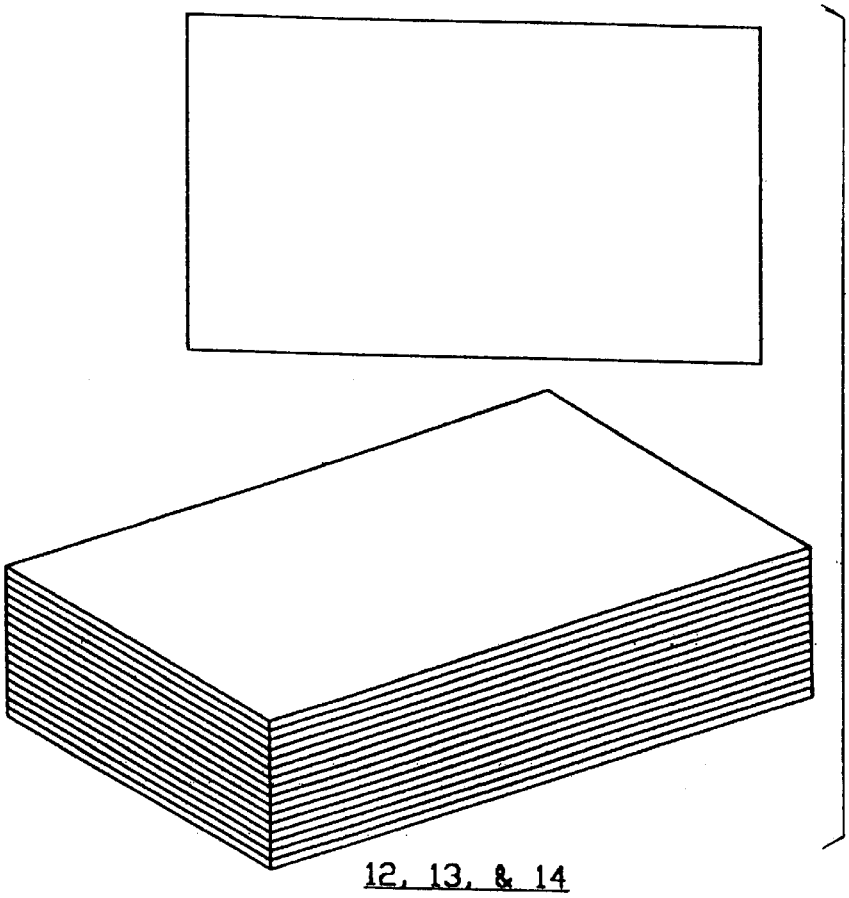
FIG. 8 Dwg. 5 illustrates a stack of cards the same being the action directive cards: fun time! 12, why me? 13, and now what? 14 in plan and isometric views.
Figure 9:
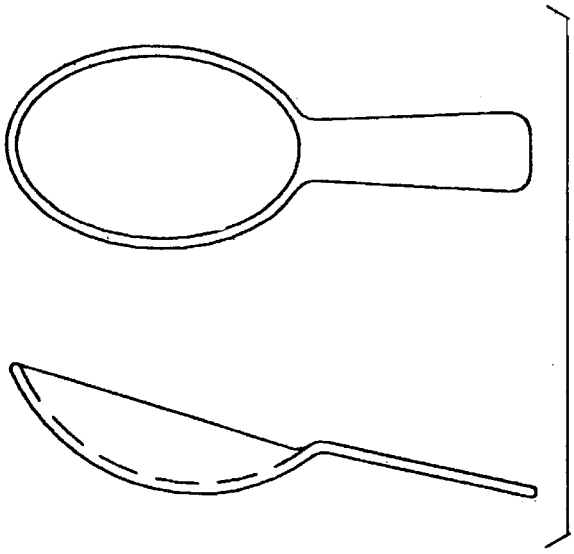
FIG. 9 Dwg. 6 illustrates the poosher 63 in plan and side views.
Figure 10:
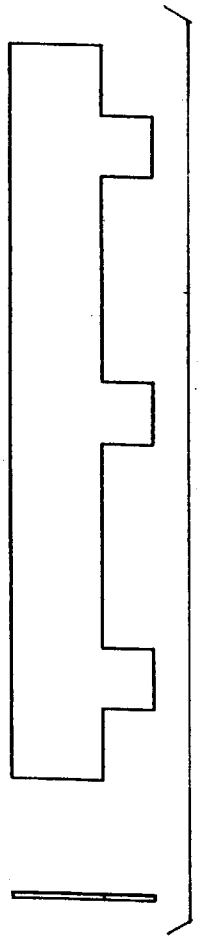
FIG. 10 Dwg. 6 illustrates the backwall 64 in plan and side views.
Figure 11:
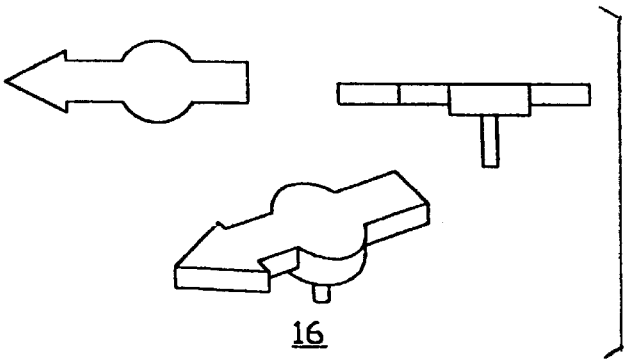
FIG. 11 Dwg. 6 illustrates the thrill-n-twirl 15 indicator/pointer 16 in an isometric view.
Figure 12:
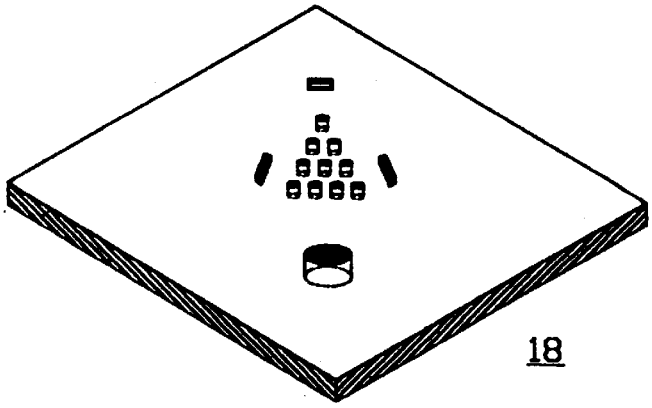
FIG. 12 Dwg. 7 illustrates the hole-a-bowl 18 in an isometric view showing indent/holes depth for the: triangle of receivers 22, poosher rest 23, and slots for backwall tabs 34.
Figure 13:
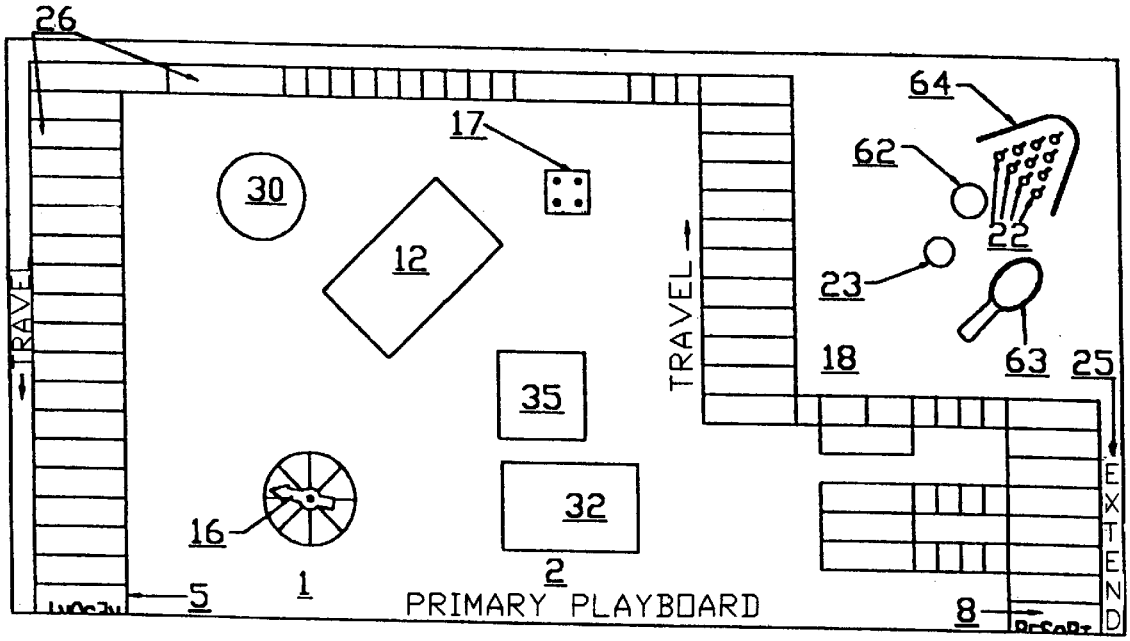
FIG. 13 Dwg. 7 is a plan view of the hole-a-bowl 18 format illustrating the: backwall 64 and poosher 63 in place, plus the sphere 62 shown about the area between the poosher rest 23 and set of receivers 22, also the thrill-n-twirl 15 indicator/pointer 16 in place.
Figure 14:
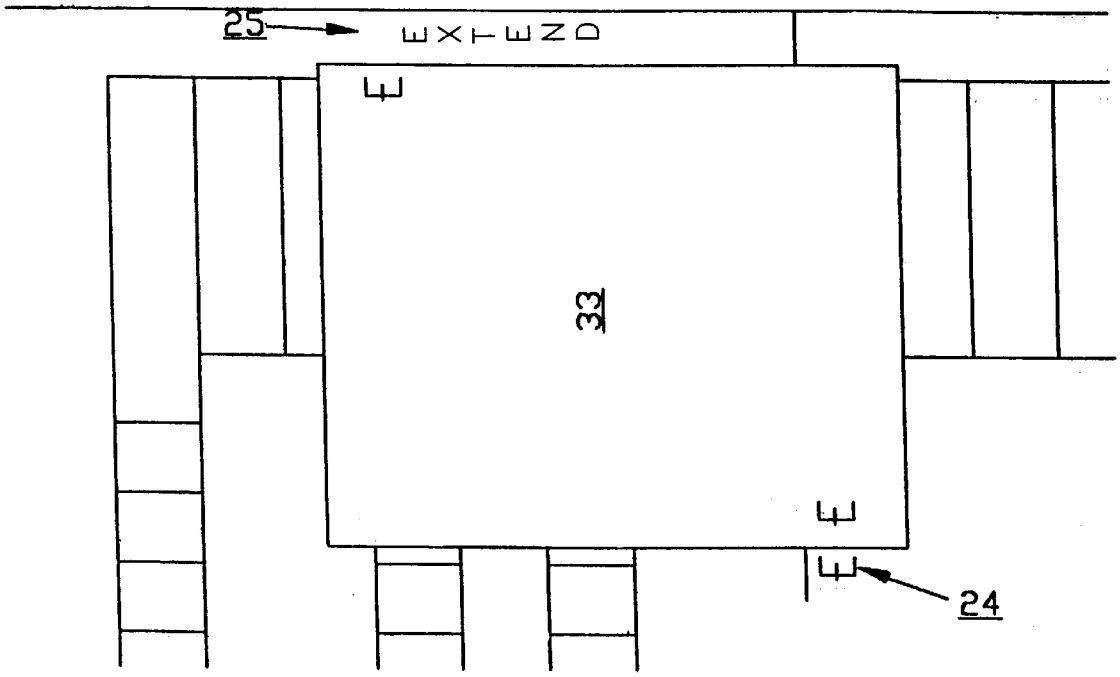
FIG. 14 Dwg. 8 is a plan view illustrating the overlay utility card vacation extension 33 being utilized in place by the matching of the "E" symbols on the card 33 with the same symbols, part of the extend words 24 & 25, on the boards 2 & 3.
Figure 15:
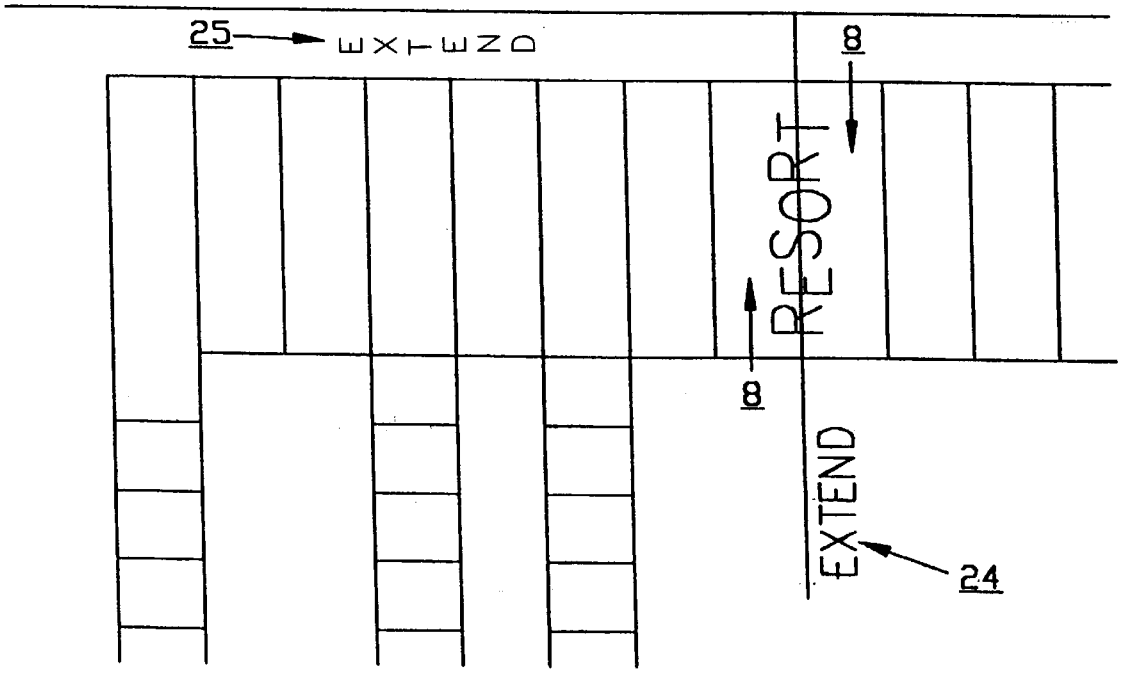
FIG. 15 Dwg. 8 is a plan view illustrating the extension resort block 8 noting the format of the RESORT letters for alignment across the two (2) boards' 2 & 3 edges. Shown also is the format of the EXTEND words 24 & 25 prior to the placing of the overlay utility card vacation extension 33.

This description of a board game apparatus begins by referring to drawing one (1) with a game board 1 as a single unit.

Construction of the game board would be of a heavy dense card or pressed board, or other material, when finished would render a rigid and smooth flat surface to be printed upon and for play.

The game board 1 in parts and shown in two (2) sections. Rectangular or square in shape but herein shown each rectangular in shape, when matched together forms a complete board of play. The concept of the playing board in sections is to enable future added occurrences and/or diversifications by the attachment or insertion of extra boards of play, yet keeping within the concept of the idea of the game.

To traverse the main path from the start to the finish describes the basis of plan for the design of the invention's game path.

The game of the preferred embodiment, rules of play 35, will enable a winner to be the player to reach "Finish/Home", but within the rules.

Below is the description of the involvement, and content of the instructions and rules.

Introduction: Game's Purpose: An entertaining, competitive and educational game of chance and talent, for multiple players of ages 10 years to adult.

Parts: Two (2) each play board sections: Primary and Option-1;

One (1) each: Dieput, Tumbler, Thrill-N-Twirl Indicator/Pointer, Hole-A-Bowl: Ball or Marble, Backwall and Poosher;

Luggage Pieces: Two (2) each rectangles—red & blue, two (2) each cubes—orange & gray, two (2) each cylinders—yellow & black, two (2) each pyramids—green & brown;

"Weather Quackers" (disks): One (1) of each of the following: solid white, solid gray, white/gray, gray/black, white/black;

Action utensil card one (1) each:"Decision Passport"; directive action cards—fifteen (15) each style: "Fun Time!", "Now What?", "Why me?"; and utility overlay card one (1) each: "Vacation Extension".

Rules: Primary Version game's object: To complete a traveled journey within rules, before all other players, exercised by chance with options of guessing, perception, skill and strategy. The rules of play for the alternative method of play "Variety Version" follow the rules of the primary method.

Preparation: Board should be set on a firm, flat, and level surface. "Option Play board-1" should be aligned with Primary Playboard by matching "RESORT" Blocks.

Hole-A-Bowl back wall tabs should be set in board slots around the triangle of holes. Place poosher on board spot marked "Poosher Bowl Rest". Place bowling ball within the triangle.

Place Thrill-N-Twirl indicator shaft in spinner hole.

Place the Tumbler, Dieput, "Weather Quackers" and "Vacation Extension" overlay, inside a box section.

"Decision Passport" has no designated place.

Action cards "FUN TIME!", "NOW WHAT?", and "WHY ME?" should be shuffled and placed on designated areas with instruction side facing downward.

Luggage: One (1) per player, should be selected and placed on "Start/Home".

Game Board and Miscellaneous:

Blocks/Spaces Cards: 1) All/any Directions/Instructions: Must be followed completely and only in the stated sequence.

2) Directions/Instructions: Shortened for convenience, "the", "a", "you", and "your" may be excluded. Example: "Thrill-N-Twirl Backward" does not mean to spin the pointer backward; rather, spin and "you" move backward, also "Roll dieput forward"—same example—means roll and "you" move forward.

3) Blank: Any block/space without directions or instructions.

4) "Start"—May always be occupied by any number of players at any time.

5) "Ignore Block Instructions"—When so directed the instructions of the space landed on are disregarded.

6) "Limit"—Maximum number of times, for the duration of the game, the block's instructions are imposed upon the player landing on it.

7) "Detour"—Starting with the next turn, luggage must follow the path of the detour unless otherwise instructed. The "Detour" space may always be occupied by any number of players at any time.

8) Except for "Detour", "Resort", "Rest", and "Start" all blocks/spaces may only be occupied by one (1) player at any time—no exceptions.

9) Occupied Space: Should luggage attempt to land on an occupied space, the luggage in movement, either forward or backward, continues in the same direction one (1) block, or as many blocks that may be occupied in continuous progression, until a "Detour", "Rest", "Resort" or "unoccupied space" is reached, whichever comes first.

10) "Go To Rest"—Luggage landing on this block does not stop, but goes directly to the "Rest" space unless otherwise instructed.

11) "Rest"—May always be occupied by any number of players at any time. Player loses one (1) turn unless otherwise instructed, and may only return to main path through "Exit Only"—No exceptions.

12) "Resort"—May always be occupied by any number of players at any time. Players option: After the roll of the dieput, but before making the move, player chooses: A) To move or, B) Pass and forfeit the move. This option may be taken on two (2) consecutive turns, but on turn three (3), the amount shown on the dieput must be accepted and the luggage moved accordingly.

13) "Finish/Home"—"Vacationing Mania Primary Version" can only be ended and won by "Finish being reached through the toss of the dieput where the amount is exactly the number required—No more—No less. Example: Should luggage be (3) three blocks from "Finish", only a (3) three will permit the luggage to proceed, land on "Finish", and win. A) Regardless of the amount tossed on the dieput, the player must move the luggage. B) Should the player roll a higher amount than required, the luggage would stop at "Finish/Home" and then go back the remaining number of blocks to complete the move.

Example: should player be three (3) spaces from Home and roll a five (5) the luggage would proceed three (3) spaces to Finish/Home then move backward two (2) spaces for a total of five (5).

Gaming Features: The "Dieput" is the originator of all moves or turns, must be tossed from the tumbler and no rerolls unless dieput stands on edge. The "Tumbler" must be used to toss the "Dieput" and Weather Quackers".

Directive Action Cards: "Fun Time!", "Why Me?", "Now What?" are drawn always from the top of the stack. Sequence of instructions must be followed in order presented. Cards finished with, tipped over or directions exposed, even if partially, must be placed on the bottom of the stack. Should player pick more than one (1) card, the top card is used and the remaining cards are placed on the bottom of the stack.

"Decision Passport": To "state" the decision, the player lays the card on the surface with decision side facing up. At the time card is placed down, decision is made. Decision is final—no exceptions and no changes! A) Where a player forgets to use the card when eligible and rolls the dieput or moves, the player's use of the card is forfeited and play stays as is. B) Player who chooses "to guess" but fails to state the number/amount must forfeit its' use and accept play as is.

"Vacation Extension" in using the overlay the question whether to prolong the game must be resolved when the first player passes the "Extending Vacation?—Resort" block. When in use the overlay card is not a block, therefore, all luggage does not stop on the card, but proceeds across the board. To prolong the game, card is placed over the block "RESORT" aligning the ("E""E") "E" card lines with the "E" extend words on the boards. Player in last place should remove the overlay upon reaching it.

Hole-A-Bowl: Player places ball in bowl of poosher, then takes aim and bowls by lifting the handle in any manner sufficient to discharge the ball without removing the bowl of the poosher from the rest spot.

If poosher bowl moves out of slot penalty occurs. Penalty: Bowling is forfeited and A) if move direction was forward, player receives a zero (0); B) if direction was backward, player receives a two (2). Except where ball does not fall into a hole, there are no rebowls. The Thrill-N-Twirl: Indicator/pointer must be positioned with "Start Arrow", and then may be spun in either direction, but only using one (1) finger. Spinner is required to complete at least one (1) full rotation or player respins, but must use a different finger. Respin qualifies if point of indicator/pointer stops on a divider line.

Weather Quackers: When "checking the weather", the disks must be tossed from tumbler. Except if any disk stands on end, there are no retossses. As they lay, they read, consequences as follows: "Sunny-N-Brite three (3) whites a delite",—player receives two (2) consecutive rolls of die, but ignores all block directions.

"Stormy-three (3) gray brings delay",—player loses (2) two turns.

"Overcast—two (2) black some slack that may cause you be passed.",—player loses one turn.

"Unsettled skies—all else—doubts arise",—player moves to nearest—(comparing backward and forward) blank space.

The Journey and Play: 1) Starting sequence is determined by the total of two (2) rolls of the die—lowest score moving first, the next lowest score moving second, etc.

Ties: Tied players only reroll for last positions. Sequence established remains the entire game—no exceptions.

2) Direction of Travel: Always forward except when directed otherwise.

3) Moves/Turns: A) All are started with one (1) toss of the dieput, and completed when luggage has been moved according to amount shown on the dieput and all directions have been followed and completed. B) Player occupies and remains on the block/space landed upon, unless directed or instructed otherwise. C) Player only moves from any space on the next turn, or if otherwise instructed.

4) Out of Turn: When the dieput is thrown out of turn sequence: A) If discovered prior to next player's roll of the dieput: all play is voided plus player moves backward to nearest "Rest" or "Start". B) If discovered after next player rolls the dieput: all succeeding players complete one (1) rotation allowing for correction of sequence while offending player forfeits one (1) turn. As corrected sequence resumes, offending player then moves backward to nearest "Rest" or "Start".

5) Backward: Luggage must move in reverse from the block it occupies remaining on the same path. Exception: Should luggage be exiting a detour onto the main path, and land on block causing backward movement, the luggage would then remain on the main path. Luggage may not enter detours backwards.

6) The "Leading" player is always the luggage nearest the "Finish", irrespective of board location.

7) All leading players are those ahead of the luggage making the move.

8) "Closest" or "Nearest" player is always determined by number of spaces, irrespective of location on the board.

9) "Last Place" player is always the furthest from the "Finish", irrespective of board location.

10) Compromise: Except for starting sequence, any ties involving more than one (1) player, being equal with another as: leading player, last player, etc., shall be resolved by means of checking the weather with rules of high hand poker being applied. Values of hands: Highest—three (3) of a kind, Next Highest—two (2) pair, Next—two (2) black, Next—two (2) white, Next—two (2) gray,—end of values.

The "Variety Version" game's object is the same as the Primary Version except the winner is only decided by player with the most points totaled after all players have reached Finish/Home. All rules of original "Vacationing Mania" apply except as follows: Points are accumulated by the number of blocks luggage contacts in forward plays. Points are all scored by forward movement only. There are no points lost or subtracted nor for backward movements. Point values of the "Dieput", "Thrill-N-Twirl", and "Hole-A-Bowl" are as shown and read. All play movement remains on the "Main Path" only. All "Rests", "Rest Paths", and "Detour Paths" are eliminated, and all instructions directing to "Rest" or "Detour" merely sends luggage to "Detour" or "Go to Rest" blocks, but not off the main path. All players reach "Finish/Home" by any roll of die equal to or more than required.

This is the end of the game's instructions and rules of play.

The alternative method of play, using the same board enables the winner to be the player with the most number of points, that is the total number of blocks accumulated in forward moves after all players have reached "Finish/Home".

Following is a basic reference of the game board 1, as a whole unit, consisting of four (4) sides which includes both sections: The "Primary Playboard 2 and the "Option Playboard #1" 3.

The main path 26, of the game board 1 as a single unit, proceeds in a counterclockwise, right to left, direction from but not including the "Start" block 4 of the start side of the board and contains thirty-six (36) blocks/spaces plus three (3) offshoots.

The main path 26 in its continuing segment along the far adjoining board edge contains twenty-four (24) blocks/spaces plus two (2) offshoots, then proceeding forward along the next adjoining board edge and continuing through an angle reaching the return side of the board edge, contained are forty-four (44) blocks/spaces plus five (5) offshoots.

The main path in its' continuing but final segment forward and along the adjoining return side of the board edge contains sixteen (16) blocks/spaces including the "Finish/Home"4.

All blocks/spaces contained within the main path and offshoots are shown in the drawings. Many blocks/spaces may be duplicated or may contain wording of similar meaning therefore only selected blocks/spaces have been referenced in index list to cite for purposes of description, purpose, location and aid in the paths layout or plan, and understanding.

A selected list for reference is at the end of the description.

The board 1 of the apparatus depicts a main path 26 incorporating spaces and/or blocks of rectangular and square shapes in various sizes. Noted, but not limited to, for making use as only sizing differential examples are four blocks/spaces 21.

This is the end of the referencing of the game board as a whole unit.

Following is the: location, mapping, directioned arrangement, wording directions, and specifications only of the offshoots of the main path. Following also is the mapping and directioned arrangement of the main path only.

The game board now expressed in its sections.

The main path 26 begins on the board titled "Primary Playboard" 2 at the block designated "Start/Finish" 4.

The start space 4 being located on the corner of the board 2 where the long outer side and short side join at the right side of the board, if facing the median/dividing edge, where both boards are aligned and come together.

Many blocks and/or spaces of the main path and offshoots may contain a couple of valueless title words for dressing or atmosphere. As referenced and noted only as examples three (3) blocks/spaces 29: "Speed Trap", "Skating Day", and "New Moon". The remaining wording being the directions/instructions and/or names of the devices and/or cards to be used. Blocks/spaces having no wording as example one (1) block/space 43 would have no meaning other than to be occupied when landed upon.

The dieput 17, a cube of six (6) sides, a die, is a common article of manufacture of a solid material with common values of dice being from one (1) through six (6) represented by figures or numerals.

Initiating all moves it is accepted that any person reading or playing this invention game would be sufficiently knowledgeable that instructions on the use of and its correlation within the game would not be necessary.

The "Tumbler" 30 a container, is used for shaking the "dieput", "Weather Quackers" disks 31, or other game items. The construction of the tumbler would be a pressed cardboard, plastic or other sturdy material to enable handling yet retain its shape. Finished, the form of a rectangular or cylindrical cup shape with one (1) end open it would be of size sufficient to encase the game items required by the rules, allowing free movement of the parts within enabling the altering of their positions.

The direction of movement of travel for the main path and detours is always forward and except where directed otherwise, towards the "Finish/Home" 4. The block/space marked "Start/Finish/Home" 4 is both the beginning and the end of the continuously progressive main path 26 that is about the board.

The main path 26 proceeds along and near the outer edge of the short side of the board 2 towards the median edge of the board straight and in line eighteen (18) blocks/spaces, not including start, onto space designated "RESORT" 5.

This "RESORT" block 5 has a two (2) fold purpose: to provide a space of play and, as with the "RESORT" block 8 directly across the board on the opposite side is to provide by the slicing in half of the letters "RESORT", the proper matching and aligning of the two (2) board sections as well as any future board additions.

The slicing of the letters RESORT would be centrally across the horizontal, with the center bar of the "R"'s being on the one (1) board section and the center bar of the "E" being on the other board section.

Continuing across and onto the adjoining side of the board titled "Option Playboard-1" 3 yet still within the same block designated "RESORT" 5 the main path progresses along and near the outer edge of the short side of the board towards the long outer edge.

From "RESORT" 5 the main path 26 proceeds four (4) blocks to the space designated "Go to Rest" 27 which incorporates an offshoot path. The player landing on this block "Go to Rest" proceeds without stopping to the adjoining "Rest"37 space unless instructed otherwise. Turning 90 degrees sideways toward the opposite side of the board 3, the offshoot proceeds one (1) space to "Rest—Lose one (1) turn"37. The player landing on this "Rest" block forfeits (1)

one move/turn. All "Rest" blocks/spaces within the game apparatus are penalty entrapments causing loss of one (1) move or turn and produce net backward travel only. Turning 90 degrees toward the median edge of the board, the offshoot proceeds one (1) block onto space "Fun Time"40. The player landing on this block draws a card from the stack noted as "Fun Time" 12 and follows the directions/instructions on the card.

All blocks titled "Fun Time" are an occurrence requiring the player to draw one (1) card. The composition of the cards to be of a semirigid or rigid paper, card stock or other material finished to resemble commercial business card stock. The card to be rectangular or square in shape and all uniform in size to allow ease of handling, yet of sufficient size to contain printed wording of instructions. The back side of the cards to contain the wording "Fun Time" while the front of the cards would contain the directions/instructions.

Within the central area of the preferred embodiment of the playboard 2 is a plurality of directive action cards 12, so termed because their function is to cause some action. Shown in a form of a stack of cards 12 which are designated "Fun Time", each card being individually printed. Shown below, but not limited to, are nine (9) originals with designated duplicates.

The wording is as follows:

The wording on the backs of the "Fun Time" Cards is: Fun Time!!

The cards and number of each contained herein, are shown: A-4, B-1, C-1, D-2, E-2, F-2, G-2, H-1.

Originals: 8, Duplicates: 7, Total: 15 cards.

With the letter being the identifying symbol of the card the wording on the front of all "FunTime!" action cards is as follows: A) Funtime! First—Roll dieput, then choose: Advance and obey block directions, or move all leading luggage backward—all players ignore all block directions.

B) Happy touring miles brings yawning smiles: Ignore all block directions as you Thrill-N-Twirl and advance, then Hole-A-Bowl—Forward.

C) "Vacationing Mania" travel blues slows down your moves. Go backward to "Resort" or "Rest", plus take any one (1) other luggage ahead of you—with you.

D) Rainy Day—No gloom this stay—Choose: Advance using Thrill-N-Twirl and obey block directions, or switch places with nearest player ahead of you—both ignore block directions.

E) Delay in reaching theater rushes in opportune choice: Advance to nearest blank space or "Exit Only" whichever comes first, or move leading luggage backward to its nearest "Rest".

F) Unexpected doctors visit aids clearer choice: Decision Passport and Hole-A-Bowl plus obey block directions, or move the luggage in lead backward to its nearest detour.

G) Harmony with relatives lifts spirits. Choose: Advance to nearest blank space or move any two (2) leading luggage backward to their nearest blank spaces.

H) Assistance to a needy stranger favors you. Choose: Roll dieput, or use "Decision Passport" with Thrill-N-Twirl or Hole-A-Bowl.

It is the unique concept of the idea of the "Fun Time" cards to provide a means of provoking occurrences, mostly of anticipation or joy to the player in movement, by causing the enabling of interfacing or direct interactions with one (1) or more other players, also, but secondarily, of apprehension, by causing interference with the player in movement but not other players. The idea for the duplicate or extra cards is to discourage any player advantage by remembering or memorizing.

A brief concept explanation on the meaning of the "Fun Time" Cards follows:

Card "A"—The player must consider location in respect to the other or leading players.

Card "B"—No strategy here, just an opportunity to use two (2) forms of entertainment.

Card "C"—Player's loss in going backward may be minimized in taking along another player.

Card "D"—The board's spaces relevant to the spinner as well as players in front requires consideration.

Card "E"—The distance of the leading player from "Home" must be considered along with the distance from the player.

Card "F"—The "Decision Passport" could be significant depending on location and instincts.

Card "G"—The game's prospective can change dramatically pending players' positions.

Card "H"—Choice of equipment, but, also the location of the board to be considered.

Turning 90 degrees facing the short start side of the board 3, from Fun Time 40 proceeding one (1) block, returning onto the main path 26 on block designated "Exit Only" 39 immediately behind "Go to Rest"27. All "Exit Only" spaces within the game apparatus are the only direction available to a player exiting a "Rest" space. A player proceeding from a "Rest" block may reenter the main path only by traveling through the "Exit Only".

Proceeding forward from "Go to Rest" 27 the main path continues along the outer short side of the board two (2) spaces onto "Tailgate Sales—Detour" 28 which incorporates an entrapment offshoot. All "Detour" offshoots maintain a path of continuity requiring the player to follow the path of disadvantageous progression, which encases various numbers of blocks, some of which may contain adverse or advantageous instructions or occurrences of chance. Offshoots as referenced examples 38 are devised divergences of contrived hazardous scenarios off of and returning to the main path. Containing a plurality of blocks/spaces in sizes and shapes as also found in the main path.

All "Detour" offshoots as "Detour" 28 contain a path proceeding forward in a clockwise, left to right, direction. All "Go to Rest" offshoots as "Go to Rest" 27 contain a path proceeding backward in a counterclockwise, right to left, direction. Where "Detour" offshoots are in themselves penalizing by directing the player away from the main path, the "Go to Rest" offshoot may be more disadvantageous as they also temporarily immobilize the player.

Turning 90 degrees sideways facing the opposite side of the board the offshoot progresses over four (4) blank spaces then onto a corner block which is a blank. Turning then 90 degrees towards the long outer edge of the board, the offshoot proceeds over two (2) blank spaces and then onto "Intuitive? Decision Passport, Thrill-N-Twirl—Backward"41. Landing on this space requires the player to take hold of an action utensil card, the "Decision Passport" 32, which not having any essential location but about the board, and make a choice.

There is only one (1) "Decision Passport" 32 per game invention and it is the unique concept of the utensil card to provide: an opportunity for use of personal notions, strategy and choices plus a mode for increasing the risk factor when used solely or in conjunction with other cards, devices or board blocks/spaces.

Within the central area of the preferred embodiment of the board 2 is the "Decision Passport" 32 which may be placed where desired. Square or rectangular in shape but larger than the directive action cards, construction of the card would be of a denser paper or card stock or other material finished to enable handling ease and printing upon.

When the player lays the card down, the side of the card showing reveals the player's decision.

Printed on both sides the wording is as follows: The front side reads:—Decision Passport—Player—Not Guessing! Player proceeds with regular move! The back side reads:—Guessing—Player—Wrong: All play is backward or loss plus ignore all block directions. Player—Correct: If play was forward—All play is doubled but ignore block directions. If play was backward or loss—all backward or loss is canceled plus player advances two (2) blocks and obeys block directions. The use of the "Decision Passport", as portrayed in the rules 35 provides the following play: If the player lays the card down exposing the top side, the player chooses not to guess the amount from the upcoming play of chance and accepts the resulting amount as is. If the player lays the card down exposing the bottom side, the player is then entitled to predict by stating the result of the upcoming play of chance and realize the consequences.

If the Player Is Wrong, all play is backward or loss plus ignores all block instructions.

If the Player Is Correct: If direction was forward all play is doubled but ignores block instructions.

If direction was backward or loss—all backward or loss play is canceled plus the player advances two (2) spaces and obeys block directions.

Should player chose to guess, but fails to state the number/amount, player must accept resulting play as is, forfeiting the card's use for this turn. Should player move, having forgotten eligibility of the card's use, the play stays as is and player forfeits the use of the card for that turn. If the block landed upon directed Thrill-N-Twirl-backward and should the player chose not to guess, the player can only spin and move backward accordingly; however, should the player choose to guess and is correct, the penalty of the block could then be turned into an advantage.

Being now at a corner and turning 90 degrees toward the short start side of the board 3, the offshoot proceeds over two (2) blank spaces, then onto "Fun Time", and then continues over one (1) blank space returning back into the main path 26 at a blank space two (2) blocks forward of the space "Tailgate Sales Detour" 28. Proceeding from "Tailgate Sales Detour"28, near and along the short start side of the "Option Playboard-1"3, the main path progresses eight (8) blocks onto space "Firehouse Sales Detour" which incorporates an offshoot.

Turning 90 degrees sideways, facing the opposite side of the board, the detour offshoot continues straight and in line proceeding over four (4) blank spaces, and then onto space designated "Hole-A-Bowl" 42 which is a corner block. Hole-A-Bowl is an original concept to provide: some manual skill, a unique play of chance, and a dynamic diversion.

Hole-A-Bowl 18, which may be about the board, but herein is shown on the "Primary Playboard" 2 containing 22, 23, 34, 62, 63, and 64, and located on the outside corner across from the "Start" block 4.

Hole-A-Bowl consists of ten (10) indents, holes or the like within a triangular shape 22 being similar to that of a bowling pin alley format, but in reverse. The holes or indentations 22 being relatively equally distant at the centers with any minimal but equal separating spacing. The indentations or holes are all the same size in diameter being to accommodate but relative in size of a sphere 62.

The indent, hole or other receiving mechanism size may be enlarged or reduced within reason to accommodate as support and hold only but not totally enveloping, thus, not out of proportion relevant to the size of the sphere 62 used.

The point value of the holes 22 within the triangle may be of any starting and differing values, but in an alternating, organized fashion. Herein are shown values of one (1) through three (3), and starting at the corner of the board and progressing outward toward the "Poosher" bowl rest 23, in left to right sequence, are: Row of one (1) hole—value: one(1); Row of two (2) holes—values: two (2), two (2); Row of three (3) holes—values: three (3), one (1), three (3); Row of four (4) holes—values: one (1), two (2), two (2), one (1).

The sphere 62 an article of manufacture is commonly known as a ball or marble. The composition and form to be any material finished to a rigid form retaining the shape of a sphere in size relative to the board, other pieces and game.

There is a "Back Wall" 64 high enough to contain any sphere 62 and is also long enough to parallel the two (2) sides of the triangle 22 facing the two (2) corner edges of the board. The back wall composition to be tin, plastic, or other material providing flexibility to enable a thin finished product of easy installation, but with firmness to contain the sphere 62. The back wall 64 has tabs that set in the board and herein shown three (3) slots 34 as follows: Behind the triangle's corner within the board's corner, and about the two (2) far triangle corners paralleling the board's sides. The back wall 64, though an aid, is not significant to the play but primarily as a retaining item only.

The "Poosher" 63, an article of manufacture commonly known as a spoon, an eating utensil, the size would be in relation to the sphere used and the necessity of handling.

Composition and form of the Poosher to be plastic, tin, or other rigid material formed to an oval shaped bowl as opposed to a round shaped bowl with an extending stem or arm when finished would resemble a small teaspoon. The indentation or hole 23 in the board 2 centrally located to and a distance at least one third (⅓) the length of the poosher 63 away from the edge of the long facing row of holes of the triangle 22 is the location of the resting spot 23 for the bowl of the "Poosher" 63.

The play of Hole-A-Bowl, as by the rules, is for the player to place the sphere, in the bowl of the "poosher" and, bowl by aiming and lifting the handle while not removing the bowl from the rest spot, discharging the sphere. Should player move bowl of the poosher from the rest spot, a penalty applies. Penalty: If player was advancing, play is forfeited and a zero (0) is rewarded. If the move was backward or loss, play is forfeited and player receives a two (2).

Turning 90 degrees and facing the long outer edge of the board 3 the offshoot from Hole-A-Bowl 42 proceeds forward straight and in line one (1) block onto "Decision Passport, Thrill-N-Twirl-Forward", where the player makes use of the Decision Passport 32, previously described, then spins the Thrill-N-Twirl 15 indicator/pointer 16 for amount of the move.

The Thrill-N-Twirl 15 of the preferred embodiment, which may be about the board but herein as shown as part of and about the center of the Primary Playboard 2, is a means of chance requiring some manual skill as may be exercised by the player.

The format of the Thrill-N-Twirl is a circle divided into a plurality of sections each of any but equal size, with a spinner indicator/pointer at the center of the circle. Each section of size, to enclose the point of the Indicator-Pointer and, to provide easy reading of a value number enclosed.

Any differing points or numerical values may be used, whose limits may be decreed by the game's format.

Any variety of starting numbers may be used but enumerated in an alternating fashion required by practicality.

Shown is a circle 19 divided into eight (8) sections with a starting point established by a "Start" arrow 20 at the section with a point value of zero (0). Continuing in a clockwise, left to right, motion from zero (0) the point values of the sections shown herein are: one (1), two (2), one (1), three (3), one (1), two (2), one (1).

The Indicator-Pointer 16, easily moved by the finger yet not cumbersome to the touch, a linear object of slender length is of an arrowhead or wedge shape as resembling that commonly found on street signs, maps, drawings or the like. Sufficient size to be of use in clearly defining the pointing to and easily recognized value number it would rest on, composition would be of plastic and/or tin or other material to enable a solid form in one (1) or more pieces.

The Indicator/Pointer is affixed to the board by a shaft being of adequate roundness and size, is perpendicular to the axis of the arrow but still part of or attached. The shaft inserts into a hole in the board located at the center of the spinner's circle format and would be of such thickness as to allow a free rotation of the indicator/pointer.

Player would respin using a different finger should pointer fail to complete a minimum of one (1) full rotation. Player would respin should pointer stop on a dividing line.

Facing the long outer edge of the board 3 the offshoot proceeds straight and in line (1) one block to a corner space "Players Choice: Roll dieput or Pick 'Fun Time!'". Any player landing upon this block would have the option of choosing the form of play. Turning 90 degrees sideways, the offshoot then proceeds back toward the short start side of the board straight and in line over four (4) blank spaces, then onto a blank space 43 on the main path 26 two (2) blocks forward of "Firehouse Sales Detour".

Blocks/spaces designated Blanks as exampled 43 do not contain directions or instructions but are part of the format enabling the paths movement and continuity of play.

Continuing from "Firehouse Sales Detour", the main path 26 proceeds along the short outer edge straight and in line toward the long outer edge of the board 3 four (4) spaces onto block "Extending Vacation? Resort" 6; which is located at the joining corner of the short outer edge and the long outer edge of the board.

Turning 90 degrees sideways, facing the opposite short return side of the board 3, the main path 26 proceeds along and near the long outer edge of the board straight and in line seven (7) spaces onto block "Tunnel Closed—Detour" where an offshoot is incorporated.

Turning 90 degrees facing the center of the board, the offshoot proceeds straight and in line over three (3) blank spaces and then onto block "Players Choice: Hole-A-Bowl or Pick Fun Time!". This being a corner block, turning 90 degrees sideway facing the short return side of the board, the offshoot proceeds straight and in line one block onto "Intuitive? Decision Passport—Next Turn"44.

Landing on this space provides the player the option of using the action utensil card 32 prior to the roll of the die on the player's next turn. The offshoot then progresses straight and in line in the same direction (1) one space onto block "Player's Choice: Thrill-N-Twirl or Fun Time!" which is a corner block.

Turning 90 degrees now facing the long outer edge of the board 3, the offshoot proceeds straight and in line over four (4) blank spaces then onto a blank space on the main path 26 two (2) blocks forward of "Tunnel Closed—Detour"54.

Continuing from "Tunnel Closed—Detour", the main path proceeds straight and in line forward along and near the board's outer edge nine (9) blocks onto space "Go to Rest" which incorporates an offshoot.

Turning 90 degrees facing the center of the board, the offshoot progresses one (1) block onto "Rest—Lose One (1) Turn", then turning again 90 degrees sideways now facing the short start side of the board, the offshoot progresses one (1) block onto space "Pick Fun Time!"45.

Turning again 90 degrees facing the long outer edge of the board, the offshoot continues one (1) space onto the main path at "Exit Only" one (1) block behind "Go to Rest".

Proceeding from "Go to Rest", the main path 26 continues along and near the long outer board edge straight and in line eight (8) blocks onto space "Resort—Limit one (1)X"7, which is located at the corner of the board where the long outer edge and the short return side edge of the board 3 join.

Being at the corner and turning 90 degrees away from the long outer edge of the board 3, the main path proceeds along the outer edge of the short return side of the board straight and in line three (3) spaces onto block "Road Closed—Detour" incorporating an offshoot.

Turning 90 degrees sideways facing the opposite short side of the board, the offshoot proceeds straight and in line over four (4) blank spaces then onto "Decision Passport and Dieput or—Advance three (3) spaces"46 which is a corner.

Landing on this block allows the player to advance three (3) spaces or use the Decision Passport, taking a chance to improve the play.

Turning 90 degrees facing the median center of the board, the offshoot progresses straight and in line one (1) block onto "Player's Choice Backward: Roll Dieput or Three (3) blocks".

This block provides a player an option to choose the fixed amount to move or take a chance for improving the play.

The offshoot then proceeds in the same direction straight and in line one (1) space onto "Player's Choice Next Turn: Roll Dieput or Fun Time". Landing on this block, the player on the next turn has the option of rolling the dieput and moving or picking a "Fun Time" card.

This block being a corner, the offshoot turns 90 degrees facing back toward the short return side of the board and progresses straight and in line over four (4) blank spaces, then onto a blank space on the main path 26 two (2) blocks forward of "Road Closed—Detour".

Proceeding along and near the short return side of the board 3 towards the long median edge of the board, the main path continues from "Road Closed—Detour" straight and in line six (6) spaces onto block "Shopping Mall Detour" which incorporates an offshoot. Turning 90 degrees sideways facing the opposite short side of the board, the offshoot progresses straight and in line five (5) blank spaces onto a corner block.

Turning then 90 degrees facing the long inside median edge of the board 3, the offshoot progresses straight and in line over one (1) blank space, then onto "Player's Choice: Advance 5 Spaces or Fun Time". Being at a corner, turning 90 degrees sideways and facing back towards the short return side of the board, the offshoot proceeds straight and in line over two (2) blank spaces then, onto "Player's Choice Next Turn: Roll Dieput or Fun Time!"47.

Continuing still in line and straight the offshoot proceeds over one (1) blank space then onto a blank space on the main path 26 being two (2) blocks forward of "Shopping Mall Detour".

Proceeding from "Shopping Mall Detour" near and along the short return side of the board 3, towards the long median edge of the board, the main path proceeds straight and in line eight (8) spaces onto "Go to Rest" which incorporates an offshoot. Turning 90 degrees facing the opposite short side of the board, the offshoot proceeds one (1) block onto "Rest—Lose One (1) Turn" where it turns 90 degrees facing backward towards the long outer edge of the board. Proceeding one (1) block onto "Fun Time", the offshoot at a corner turns 90 degrees sideways facing the short return side of the board.

Continuing one (1) block onto "Exit Only" on the main path 26 one (1) block behind "Go to Rest".

Along and near the short return side of the board 3 facing the long inside median edge of the board, the main path 26 from "Go to Rest" proceeds one (1) space onto block "Extension—RESORT" 8 which spans the two (2) play board sections.

As this is an adjoining block, the movement of the luggage to the adjoining "Primary Playboard" 2 is still within the same block, thus the main path continues across and onto the "Primary Playboard" section 2 in continuity from board 3.

Along and near the edge of the short return side of the board now facing the long outer edge of the board 2, the main path proceeds from "RESORT" 8 two (2) blocks onto "Garage Sale Detour—Limit 1X" incorporating an offshoot.

Turning 90 degrees sideways facing the opposite short side of the board, the offshoot progresses straight and in line over four (4) blank spaces then onto "Player's Choice: Roll Dieput or Fun Time!"48, at a corner.

The offshoot now turns 90 degrees facing the long outer edge of the board 2 and proceeds straight and in line one (1) block onto "Decision Passport, Hole-A-Bowl, Forward". Proceeding straight and in the same direction the offshoot proceeds one (1) block onto "Player's Choice Backward: Thrill-N-Twirl or Hole-A-Bowl".

Being at a corner the offshoot turns 90 degrees facing towards the short return side of the board 2 and progresses straight and in line over four (4) blank spaces then onto a blank space on the main path two (2) blocks forward of "Garage Sales Detour Limit 1X".

Proceeding from "Garage Sales Detour Limit 1X" along and near the short return side of the board 2 facing the long outer edge, the main path 26 proceeds five (5) spaces onto block "Diner Mishap, Decision Passport, Thrill-N-Twirl—Backward" 9.

Being a corner block, the main path turns 90 degrees sideways facing the opposite short side of the board and proceeds straight and in line six (6) blocks onto "Go to Rest" incorporating an offshoot. Turning 90 degrees facing the long inside median edge of the board 2 the offshoot proceeds one (1) space onto "Rest—Lose one (1) turn—Limit One (1 )X"49.

Turning one hundred eighty (180) degrees, the offshoot proceeds one (1) block onto "Exit Only" on the main path one (1) block behind "Go to Rest".

Turning another 90 degrees now facing the short start side of the board, the main path 26 from "Go to Rest" proceeds straight and in line two (2) blocks onto a corner space designated "Last Fling, Decision Passport, Roll Dieput—Backward" 10.

Turning 90 degrees and facing the long outer edge of the board 2 the main path 26 progresses straight and in line eleven (11) blocks onto designated space "Overanxious? Hole-A-Bowl—Backward" 11. This block being a corner and turning 90 degrees sideways facing the short start side of the board, the main path 26 along and near the long outer edge of the board 2 proceeds straight and in line sixteen (16) spaces onto the end block designated "Finish/Home" 4.

This is the end of only the directioned arrangement and mapping of the main path 26. This concludes the entire charting, directioned arrangement, mapping, wording, directions, and specifications of the blocks/spaces contained within all of the offshoots.

Following is the charting, mapping, wording, directions and specifications of the blocks/spaces contained only in the main path 26.

The block/space designated "Start/Finish/Home" 4 placed on the "Primary Playboard" section 2, and facing the long median inside edge of the board, is located at the right hand corner where the long return and short start edges of the board 2 join.

The game begins at the "Start" 4 where players place their game markers or play piece "Luggage" 36, as the luggage represents the players.

Shown within the central area of the playboard 3 the "Luggage" 36 are a plurality of markers/game pieces in common forms resembling basic geometric shapes. Shown herein, but not limited to one (1) of each but also not limited to rectangles 66, cubes 65, cylinders 67 and pyramids 68. The composition of the "Luggage" 36, being of plastic, wood, or other matter, that when finished would produce an item in size able to fit within the board's blocks/spaces yet firm of sufficient solid permitting withstanding and ease of handling. Sufficient quantities without exact duplication to enable ease of distinguishing would be by varying sizes adding slight alterations or modes and/or differing colors but retaining the basic shapes.

Beginning at the "Start" block 4, the main path near and along the short outer edge of the board 2 toward the long inside median edge of the board straight and in line proceeds (but not including the "Start") over two (2) blank spaces, then onto space designated "Smile and Advance Three (3) Spaces". Continuing forward in the same direction, straight and in line, the main path 26 proceeds one (1) block onto "Having Fun? Advance Two (2) Spaces". Player landing on either of these blocks moves forward as instructed.

Continuing forward in the same direction, straight and in line, the main path continues over one (1) blank space then onto "Forgot Tickets Back to Start—Limit One (I)X"50. Player landing on this space moves the luggage back to the "Start" block.

As provided in the rules, the "limit" places a maximum number to which a player may be subjected to the directions of the block or space for the duration of the game. Thus the total number of times a player must go back to start when landing on this block would be one (1) time regardless of how many times during the game the player would land on this same space.

Continuing forward straight and in line the main path proceeds one (1) block onto "Forgot Money—Back to Start—Limit Two (2)X". Landing on this space, a player is penalized but is limited from the same penalty applying more than twice. It is the intention of the game over the first seven (7) spaces to demonstrate, through a created atmosphere, use of concentration and thought will be necessary in the playing.

Continuing along and near the short outer edge of the board 2 the main path 26 proceeds forward in the same direction over one (1) blank space then onto "Circus Day, Hole-A-Bowl"51.

This block has, as with Diner Mishap 9 and many of the blocks, contain some suggestive aesthetic wording used to create a thought as this block uses "Circus Day". Although the words have no significant bearing on the game or play the suggestion may create some relating tone or stimulus; as in this instance, circus, as relating to a carnival or amusement arena. Continuing forward in the same direction straight and in line the main path proceeds over one (1) blank space then onto "New Moon—Check Weather"52. Landing on this space the player checks the weather by utilizing the "Weather Quackers" 31.

The concept of the "Weather Quackers" is to provide a unique means of: chance, and additional excitement, plus a means of enabling use of personal notions and strategy. A plurality of disks 31, of any size but uniform in shape and size, resembling or similar to money tokens or coinage as nickels, quarters or pennies. The composition being a plastic, pressed cardboard or other stiff material finished to be easily handled and durable. The pigments of the colors used are not significant, but that they are different colors or tones, as it is the manner applied that is the fundamental concept of the idea. The color combination selectively designed is to prevent more than one (1) combination from appearing simultaneously.

The disks 31 being of any plurality but herein shown as five (5) disks each being separately color coded, the color application used is as follows: one (1) each—solid white, one (1) each—solid gray, one (1) each—gray on top side, white on bottom side, one (1) each—gray on top side, black on bottom side, one (1) each—white on top side, black on bottom side.

The player tossing all "Weather Quackers" from the tumbler 30, would observe the colors and follow the directions provided in the rules pertaining to the resulting tossed arrangement of the disks. A player does not retoss except if a disk stands on edge.

Instructions on the disks' arrangement as provided in the rules 35 are: "Sunny-N-Brite three (3) whites a delite",—player receives two (2) consecutive rolls of die, but ignores all block directions; "Stormy—three (3) gray brings delay",— player loses two (2) turns;

"Overcast—two (2) black some slack that may cause you be passed",—player loses one turn;

"Unsettled skies-all else—doubts arise",—player moves to the nearest (comparing backward and forward) blank space.

Although "Sunny-N-Brite", "Stormy" and "Overcast" remove any doubt regarding the player's direction or play, the "Unsettled Skies" allows for the play direction to be dependent upon the position of the player on the board, for it would be the number of spaces from the nearest blank space in front of or behind the player that would determine the direction and distance the player would travel.

All "Check Weather" or "Check the Weather" instructions require use of the "Weather Quackers".

Continuing straight and in line from "New Moon Check Weather" 52 the main path 26 proceeds forward one (1) block onto "Skating Day, Decision Passport, Hole-A-Bowl". Continuing straight and in line the main path proceeds forward over one (1) blank space then onto "Speed Trap, Decision Passport, Thrill-N-Twirl—Backward".

Continuing along and near the short side of the board 2 the main path 26 proceeds forward straight and in line over one (1) blank space onto "Beach Day—Check Weather"; then over one (1) blank space, then forward straight and in line onto space designated "RESORT" 5 which is at the middle of the combined boards; that is on the long median edge where both boards join.

All "Resort" blocks provide the player with the option of passing and forfeiting the move on the roll of the dieput two (2) turns, but on roll of the dieput on turn three (3) the player must accept the roll of the dieput and move accordingly. Providing the player an optional means of using the chances of play, is the unique feature of the concept of the idea of the "Resort" spaces, enabling the use of the player's perception and personal notions.

It is the purpose of this "RESORT" 5 space as well as the "RESORT" 8 space directly across the long shared median edge to aid in the aligning and joining of the two (2) boards plus any future board inserts or additions. Spanning both boards the single space of each of the two (2) blocks makes proper alignment easy since the word "RESORT" would be sliced across all of the letters so a portion of each letter would be on both board sections necessitating proper alignment including additions.

The letters would be sliced as follows: the tops of some letters including the middle bar of the "R" letters would be on one board while the bottom portion of the remaining letters including the middle bar of the "E" letter would be on the other adjoining board.

The main path 26 continuing then within the space designated "RESORT" 5 goes across and onto the "Option Playboard #1" 3. The main path along and near the short start side edge of "Option Playboard #1" proceeds forward straight and in line towards the long outer edge of the board one (1) block onto "Intuitive? Decision Passport, Thrill-N-Twirl Forward", then one (1) space onto "Happy Hour, Advance two (2) blocks".

Continuing straight and in line the main path 26 proceeds one (1) block onto "Exit Only" then proceeds one (1) block onto "Go to Rest" 27, then one (1) block onto "Intuitive? Decision Passport—Next Turn".

Continuing along and near the short start side of the board 3 the main path 26 progresses straight and in line one (1) space onto "Tailgate Sales—Detour" 28, then one (1) block onto "Ski Mishap, Go Backward One (1) Block", then onto one (1) blank space.

Continuing straight and in line the main path 26 proceeds forward one (1) block onto "Fun Time", then one (1) block onto "Feel Lucky? Decision Passport—Next Turn", then one (1) block onto "Travel Option: Now What? or Why Me?" 53. Landing on this space provides the player with choosing one (1) of the two (2) directive action cards offered.

Proceeding then one (1) block onto "Lu-Au Time, Check Weather", then one (1) block onto "Risky Play—Go Backward Two (2) Blocks". Continuing along and near the short start side of the board straight and in line the main path progresses one (1) space onto "Firehouse Sales Detour", then one (1) space onto "Shortcut Pays, Hole-A-Bowl Forward", then over one (1) blank space, then onto "Player's Choice: Roll Dieput or Fun Time".

Continuing straight and in line the main path 26 proceeds one (1) space onto block designated "Extending Vacation? Resort" 6.

The players' option of the "Resort" space remains intact, however, upon the first player reaching this space during play, according to the rules of the game, all players must resolve at this point the question to extend the game. If play is to be prolonged, the "Vacation Extension" utility overlay card 33 is put in place over "RESORT" 8.

This space 6 is also at a corner joining the long outer and short start sides of the board where the main path 26 turns 90 degrees facing the opposite short return side of the board 3.

Continuing from "Resort" 6 along and near the long outer edge of "Option Playboard-1" 3, the main path 26 progresses straight and in line over two (2) blank spaces then onto "Player's Choice: Now What? or Why Me?" then onto "Decision Passport—Next Turn". Continuing forward straight and in line the main path 26 proceeds over two (2) blank spaces onto "Tunnel Closed—Detour"54, then proceeds straight and in line over seven (7) blank spaces, along and near the long outer edge of the board towards the short return side of the board onto "Exit Only" then one (1) block onto "Go to Rest".

Continuing forward straight and in line the main path proceeds over four (4) blank spaces onto "Player's Choice: Now What? or Why Me?". Continuing forward the main path proceeds straight and in line one (1) block onto "Water Rafting, Hole-A-Bowl Backward", then over one (1) blank space, then onto a corner block designated "Resort—Limit One (1 )X" 7.

Landing on this space a player is afforded the benefits of the resort space but only a total of one (1) time the entire game. This space is located at the corner where the long outer edge and short edge return side of the board join.

From the space "Resort—Limit One (1)X" 7 the main path 26 turns 90 degrees along and near the short return side of the board 3 and proceeds forward straight and in line towards the joining median edge of the board one (1) space onto "Fun Time"55.

Continuing forward straight and in line the main path proceeds one (1) block onto "Be Happy As You Advance one (1) space", then one (1) block onto "Road Closed—Detour", then one (1) block onto "Player's Choice: Now What? or Why Me?". Continuing forward, straight and in line the main path 26 proceeds over one (1) blank space then onto "Kite Flying—Check Weather", then one (1) block onto "Player's Choice: Now What? or Why Me?".

Continuing along and near the outer edge of the short return side of the board facing the median joining edge, the main path 26 proceeds straight and in line forward one (1) space onto "Fun Time", then one (1) block onto "Shopping Mall—Detour", then one (1) block onto "Treasure Hunt, Thrill-N-Twirl Backward or Pick Now What?". Landing on this block causes the player more thought in reference to other players' board positions than the obvious card vs spin choice.

Continuing forward straight and in line the main path proceeds over one (1) blank space onto "Feel Lucky? Decision Passport—Next Turn", then one (1) block onto "Trap Shoot: Roll Dieput Backward or Pick Why Me?". The player here needs to consider the full consequences of the choice.

Continuing forward, straight and in line along and near the outer edge of the short return side of the board 3, the main path proceeds one (1) block onto "Sightseeing! Check Weather", then one (1) block onto "Dance Marathon—Advance two (2) spaces"56.

Continuing forward, straight and in line the main path 26 progresses one (1) block onto "Exit Only", then one (1) block onto "Go to Rest", then one (1) block onto "Extension, RESORT" 8, where landing on this space, players enjoy the options of the "Resort" blocks.

This block, as with the "RESORT" 5 on the opposite short side of the board join both play boards, and though divided by the division of the board 1, both blocks maintain as one (1) single space each.

This block 8 serves also as the spot for the placing of the utility overlay card 33. "Vacation Extension" is a unique feature with the concept of providing for: prolonging of the game, and a means of promoting at "Resort" 6 interactive player communication. To facilitate the efficient use of the card, the portion of the "RESORT" block 8 on the "Option Playboard-1" 3 has the word "E XTEND" 24 horizontally but being perpendicular and next to the block 8, plus the portion of the "RESORT" block 8 on the "Primary Playboard" 2 has the word "E XTEND" 25 on the opposite side of the block vertically but paralleling the board's outer edge and about the spaces above the "RESORT" block 8.

The beginning "E" in each of the "EXTEND" word contains an elongated middle bar to be aligned with the elongated middle bar as here noted the "E" two (2) of each on the "Vacation Extension" utility overlay Card 33.

Continuing from the block "Extension RESORT" 8 on the "Primary Playboard" 2 along and near the short return side of the board 2 straight and in line the main path 26 proceeds one (1) block onto "Good Planning: Advance one (1) space"57.

Any space directing "advance" such as: "Advance one (1) space or through a play of chance such as: "Thrill-N-Twirl and Advance", means to move forward. The main path then continues one (1) block onto "Garage Sales—Detour Limit One (1)X", then one (1) block onto "Decision Passport, Hole-A-Bowl Backward"58. Continuing straight and in line the main path 26 progresses forward over one (1) blank space then onto "Player's Choice: Now What? or Why Me?", then over one (1) blank space, then onto "Diner Mishap, Decision Passport, Thrill-N-Twirl—Backward" 9.

This block is a corner at which the main path turns sideways 90 degrees facing the opposite short start side of the board 2.

From the space "Diner Mishap" 9 straight and in line the main path proceeds forward over four (4) blank spaces, then onto "Exit Only".

Continuing straight and in line the main path proceeds forward one (1) block onto "Go to Rest", then over one (1) blank space, onto "Last Fling, Decision Passport, Roll Dieput—Backward" 10. This block is a corner at which the main path turns 90 degrees away from the long inside median board edge and facing the long outer edge continues in parallel with the short side of the board 2. The path 26 proceeds toward the long outer edge of the board 2 straight and in line one (1) block onto "Vacancy Taken—Check Weather", then one (1) block onto "Decision Passport—Next Turn". Continuing straight and in line the main path proceeds forward one (1) block onto "Racing Cars—Check Weather", then over one (1) blank space, then forward onto "Decision Passport—Next Turn". Continuing straight and in line, the main path proceeds forward one (1) block onto space "Now What?"59.

All blocks designated "Now What?" are occurrences requiring the player to draw one (1) card from the stack 14 and follow the printed directions/instructions of the card. There are a plurality of originally devised "Now What?" cards with accompanying duplicates in the invention game and herein shown but not limited to are nine (9) original plus accompanying six (6) duplicates as noted totaling fifteen (15) cards.

All directive action cards titled "Now What?" would be of the same construction, material, size and shape as the "Fun Time!" cards but not of the same wording or color styling. Within the central area of the preferred embodiment of the board 3 is a plurality of directive action cards, so termed as their function being to cause some action.

Shown in a form of a stack of cards 14 which are designated "Now What?" 14, each card being individually printed, the wording is as follows:

The wording on the backs of the "Now What?" cards is: Now What?

The wording on the fronts of the cards as well as the number of each are as follows: A-2, B-4, C-1, D-1, E-1, F-1, G-2, H-1, I-2, totaling Originals: 9, Duplicates: 6, Total: 15.

The wording on the fronts of all "Now What?" Cards are as follows; the letter is the identifying symbol. A) Getting your way causes strife: change places with player in last place. Both players ignore all block instructions.

B) Now What? A/C break in desert ends in a touring mess. Go backward to nearest "Resort" or "Rest" plus take luggage of any one (1) other player with you.

C) Motion sickness makes bad day. Ignore all block directions as you Hole-A-Bowl, then Thrill-N-Twirl, then multiply both for total number to move backward.

D) Party time overindulging produces touring inactivity—choose: Go backward to nearest "Rest" or pick "Why Me?"

E) "Vacationing Mania" makes happy—select one and smile: Advance to nearest blank space or remain on block and pick "Fun Time".

F) Bowling ball dropped on foot puts crimp on time. Ignore all block instructions as you Hole-A-Bowl two (2) times and multiply both for total number to go backward.

G) Meeting a forgotten relative bewilders choice: Remain on block and pick "Why Me?", or return to start of move and have the leading player pick "Now What?".

H) Valet mix up of attire leaves you in a fix. Choose: Change places with nearest luggage behind you or roll die backward. All players ignore all block directions.

I) Or—What Now? Use card now by: trade for play and stay on block or return to start of move and keep card for future trade to cancel one (1) other "Now What?" or one (1) release from "Rest".

It is the unique concept of the "Now What?" cards 14 to provide a means of provoking occurrences of: mostly apprehensive interference on the player in movement but not on other players, also but secondarily of joy or anticipation by causing the enabling of some interfacing or direct interactions with other players. The idea for the duplicate or extra cards is to discourage any player advantage by remembering or memorizing.

A brief concept explanation on the meaning of the "Now What?" cards follows:

Card "A" This card will do well with the leading player. Card "B" Taking another player also, may be some consolation for going backward. Card "C" The provoking thought and use of suggestion may be the benefit to the game. Card "D" The backward move could be advantageous. Card "E" This may be beneficial to the player lagging behind. Card "F" This card is strictly for amusement. Card "G" Is the question which cards have been played or where is the "luck"? Card "H" This card has the potential of rearranging the leaders. Card "I" This card was devised for strategy and/or use of personal notions.

Continuing straight and in line the main path 26 from "Now What?" 59 progresses forward one (1) block onto "Fun Time", then forward one (1) block onto space "Why Me?"60.

All spaces designated "Why Me?" are occurrences requiring the player to draw one (1) card from the stack 13 and follow the printed directions/instructions of the card. There is a plurality of originally devised "Why Me?" cards with accompanying duplicates in the invention game and herein shown 13 but not limited to are nine (9) originals plus accompanying six (6) duplicates as noted totaling fifteen (15) cards.

All directive action cards titled "Why Me?" to be of the same construction, material, size and shape as the "Fun Time!" cards but not of the same wording or color styling.

Within the central area of the preferred embodiment of the board 3 is a plurality of action directive cards, so termed as their function is to cause some action. Shown in a form of a stack of cards 13 which are designated "Why Me?" 13, each card being individually printed, the wording is as follows:

The wording on the backs of the cards is: WHY ME???

The wording and identification letter on the fronts of the cards plus the number of each are as follows: A-1, B-1, C-1, D-2, E-2, F-4, G-1, H-2, I-1, totaling Originals: 9, Duplicates: 6, Total: 15.

The wording on the fronts of all "Why Me?" action cards are as follows; the letter is the identifying symbol. A) Disregarded map causes wrong way back. Ignore all block directions as you: Thrill-N-Twirl to go backward, then Hole-A-Bowl backward.

B) Flat tire—No Spare! Time Value Made Aware! Ignore all block directions as you roll dieput, then Thrill-N-Twirl; then multiply both for total number to go backward.

C) Lost Check Book Causes Chaos: If in last place Hole-A-Bowl and ignore all block directions, but if in other than last place, roll dieput, to go backward and obey block directions.

D) Muck on Shoes Yields Tacky Choice! Select One: Go backward to nearest "Rest", or pick "Now What?", or roll dieput backward and ignore block instructions.

E) Miscue With Relatives Leaves You Uncertain. Switch with player in last place, but if you are in last place, check the weather.

F) Why Me??? Because!!! Travel Irritability Moves You: Go backward to nearest "Rest" plus take along any one (1) other player's luggage.

G) "Vacationing Mania" Awards Choice: Advance to nearest "Fun Time" and pick or roll dieput and obey block directions, or switch with furthest player ahead of you and both ignore block directions.

H) Out of Fuel! No Motion=No Chance! Choose: Switch with nearest luggage behind you and both ignore block directions or you go backward to third ($3^{rd}$) blank space.

I) Me? Why? Surprise!!! Use card now to trade for play and return to start of move, or remain on block and keep card for one (1) time future trade to cancel a "Why Me?", or a release from "Rest".

The unique concept of the "Why Me?" cards 13 is to provide a means of provoking occurrences of: mostly apprehensive interference on the player in movement but not on other players, also but secondarily of joy or anticipation to the player in movement by causing the enabling of some interfacing or direct interactions with one (1) or more other players. The idea for the duplicate or extra cards is to discourage any player advantage by remembering or memorizing.

A brief concept explanation on the idea meaning of the "Why Me?" cards follows:

Card "A" No strategy here, just pure penalty. Card "B" Another penalty card without escape. Card "C" Depending on the player's location, this card may provide consternation. Card "D" The question is which choice demands the least penalizing move? Card "E" This card is designed to assist the player in last place. Card "F" A design on irritating amusement. Card "G" A fun card to help a player in any situation. Card "H" A promotion on diversionary thinking. Card "I" A strategy card and use of personal notions.

Continuing straight and in line paralleling the short sides of the board 2 and facing the long outer edge of the board the main path 26 from "Why Me? 60 progresses forward over one (1) blank space, then onto "Fun Time", then one (1) block onto space designated "Overanxious? Hole-A-Bowl Backward" 11.

This space is a corner at which the main path turns 90 degrees facing the short start side of the board.

Continuing forward from the block "Overanxious?" 11 and away from the short return side of the board, straight and in line but along and near the long outer edge of the board 2, the main path 26 progresses over three (3) blank spaces onto "Decision Passport—Next Turn"61.

Continuing forward, straight and in line the main path proceeds forward over ten (10) blank spaces, onto "Impatient? Thrill-N-Twirl Backward", then one (1) block onto "Finish/Home" 4, completing the main path 26.

This completes the mapping, and progression as well as the wording, specifications and directions of the blocks/spaces within the main path 26.

Below is a Reference List, for convenience use only, showing reference numbers, appropriate blocks/spaces and items with a noting of their relevance to the game.

| Selected List of Reference | Relevance to Game |
|---|---|
| 1) Game board | Both halves as a whole |
| 2) Primary Playboard | Board half |
| 3) Option Playboard #1 | Board half |
| 4) Start/Finish/Home | — — — -Block |
| 5) Resort | -Connecting Block |
| 6) Extending Vacation? Resort | -Block |
| 7) Resort- Limit 1X | -Block |
| 8) Extension Resort | — — — -Connecting Block |
| 9) Diner Mishap | -Block |
| 10) Last Fling | -Block |
| 11) Overanxious? Hole-A-Bowl | -Block |
| 12) Fun Time! | — — — -Action Cards Stack |
| 13) Why Me? | -Action Cards Stack |
| 14) Now What? | -Action Cards Stack |
| 15) Thrill-N-Twirl | -Spinner |
| 16) Indicator/Pointer | — — — -Spinner Arrow |
| 17) Dieput | -Gaming Piece |
| 18) Hole-A-Bowl | -Device Format |
| 19) Spinner Circle | -Device Format |
| 20) Start Arrow | -Spinner Start |
| 21) Blocks/Spaces | -Sizes Differentials Examples |
| 22) Set of Holes | — — — -Triangle |
| 23) Bowl Rest | -Poosher Spot |
| 24) Extend | -Word-Horizontal Alignment |
| 25) Extend | -Word-Vertical Alignment |
| 26) Main Path | — — — -About the Boards |
| 27) Go to Rest | -Block |
| 28) Tailgate Sales Detour | -Block |
| 29) Speed Trap,Skating Day and New Moon | -Aesthetic Wording Examples |
| 30) Tumbler | — — — -Shaker |
| 31) Weather Quackers | -Disks-Gaming Feature |
| 32) Decision Passport | -Utensil Action Card |
| 33) Vacation Extension | -Utility Overlay Card |
| 34) Slots | — — — -Backwall Tab Holes |
| 35) Rules Booklet | -Instructions |
| 36) Luggage | -Players' Markers-65-66-67-68 |
| 37) Rest- Lose One (1) Turn | -Block |
| 38) Offshoots | — — — -Differential Examples |
| 39) Exit Only | -Block |
| 40) Fun Time | -Block |
| 41) Intuitive? Decision Passport | -Block |
| 42) Hole-A-Bowl | — — — -Block |
| 43) Blank space | -Block Examples |
| 44) Intuitive? Decision Passport | -Block |
| 45) Pick Fun Time | -Block |
| 46) Decision Passport- Advance | — — -Block |
| 47) Player's Choice Next Turn | -Block |
| 48) Player's Choice: Roll | -Block |
| 49) Rest Lose one (1) turn | -Block |
| 50) Forgot Tickets Back to Start | — — -Block |
| 51) Circus Day, Hole-A-Bowl | -Block |
| 52) New Moon- Check Weather | -Block |
| 53) Travel Option | -Block |
| 54) Tunnel Closed- Detour | — — -Block |
| 55) Fun Time | -Block |
| 56) Dance Marathon-Advance | -Block |
| 57) Good Planning- Advance | -Block |
| 58) Decision Passport, Hole-A-Bowl | — — -Block |
| 59) Now What? | -Block |
| 60) Why Me? | -Block |
| 61) Decision Passport | -Block |
| 62) Sphere | — — — -Gaming Ball |
| 63) Poosher | -Gaming Tool |
| 64) Backwall | -Retainer/Fence |
| 65) Cube | -Luggage, Game Markers |

-continued

| Selected List of Reference | Relevance to Game |
|---|---|
| 66) Rectangle | — — — -Luggage, Game Markers |
| 67) Cylinder | -Luggage, Game Markers |
| 68) Pyramid | -Luggage, Game Markers |

The general characteristics or intended means of this herein disclosed invention may be embodied in other specific forms. Therefore, the described embodiments are to be all considered illustrative and not restrictive in all aspects. The scope of the invention is to be realized by the appended claims more properly than solely by the detailed description, intending all changes to come within the meaning of the claims.

What I claim as my invention is a board game apparatus comprised of:

1. A board game comprising: a plurality of game pieces; a first chance device including a six-sided die, each side having a numeral from one to six; a second chance device including a plurality of rows of holes on said game board, said holes all having the same size or diameter, each hole being relatively equally distant from each other, said rows of holes positioned to form a triangular shape, each of said holes having a point value, a sphere having a diameter sized for resting on any one of any said holes, a spoon for discharging said sphere toward said holes, said spoon comprising an oval shaped bowl for receiving said sphere therein, and said spoon having an extended stem, an indentation on said game board for resting said oval shaped bowl thereon while discharging said sphere from said oval shaped bowl using said extending stem, said indentation located a predetermined distance away from said plurality of rows of holes; a game board having a circuitous main path inscribed along the periphery of said game board, said main path is subdivided into a plurality of spaces including a Start/Finish space, said game board further including a plurality of offshoot paths, each offshoot path is subdivided into a plurality of spaces which detour from the main path toward the central area of the game board, each offshoot path begins at a detour space on the main path for entering an offshoot path, and ends at an exit on the main path for exiting the offshoot path, movement of said game pieces along said main path and along said offshoot paths is determined by the roll of said die, said spaces on said main path and said spaces on said offshoot paths include indicia for instructing the operation of said second chance device for determining the movement of said game pieces along said main path and along said offshoot paths, wherein the amount of movement of a game piece is determined by the point value of the hole which said sphere ultimately rests on after discharge; a third chance device, including a spinner for determining the movement of said game pieces.

2. The board game as recited in claim 1 wherein said game board is divided in sections each of similar size, said sections together form the playing board, said sections where the board divides causes the main path to separate, said main path where separation occurs contains a single space to cause continuity of the said path from board one to another board, said space on each board divided by the spacing between the boards are a singular space each with indicia, said indicia within said spaces designed in format spanning both boards is within the same space, said indicia within said space within said path causes correct placing of an additional board, insert or a plurality of boards causing the correct continuity of the path and directional movement of game pieces providing for and enabling the enlarging of the playing area and expansion of the game.

3. The board game as recited in claim 1 further comprising a fourth chance device, having a plurality of disks in a designed format of color coding, said disks have no singular value nor value on a single color, said plurality of disks comprising: disks in any rigid or semirigid shape or size but all in uniform shape and size, a first disk having a color the color being uniform wherein the color being the same on the top and bottom of said first disk; a second disk having a uniformity of color the color being different from the first disk; a third disk having a color the color on the top being the same color as the first disk with the color on the bottom being the same color as the second disk; additional disks all to have color of varying combinations, said additional disks each disk comprising: tops having a color being the same as the first or second disk, bottom having a color different from the colors of the first and second disks, bottom having color, said disks as they lay one side showing the combination of said disks providing a determining result for corresponding the movement of said game pieces.

4. The board game as recited in claim 1, further comprising an optional chance device, having a utensil card, said card optionally used by a player corresponding to the movement of said game pieces, said card contains: indicia.

5. The board game as recited in claim 1 further comprising a plurality of sets of directive action cards, said sets containing a plurality of cards wherein the correct selection by the player would be as directed by the indicia on the board spaces, or other directive action cards, said cards have indicia requiring the player in movement to make a choice, said choices including: causing the player to continue in movement, or select another card, or use one or more devices; causing the player to move one or more other game pieces; or causing the player to have another player select one of the directive action cards; or causing one or more players to use one or more of said chance devices; or using a combination of any of the above, said cards though affecting the piece in movement may also cause interfacing or interaction with other pieces which may rearrange the game pieces or alter the winning conditions.

* * * * *